US007731341B2

(12) United States Patent
Trauernicht et al.

(10) Patent No.: US 7,731,341 B2
(45) Date of Patent: Jun. 8, 2010

(54) CONTINUOUS FLUID JET EJECTOR WITH ANISOTROPICALLY ETCHED FLUID CHAMBERS

(75) Inventors: David P. Trauernicht, Rochester, NY (US); Christopher N. Delametter, Rochester, NY (US); John A. Lebens, Rush, NY (US); James M. Chwalek, Pittsford, NY (US); Gary A. Kneezel, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 1016 days.

(21) Appl. No.: 11/220,514

(22) Filed: Sep. 7, 2005

(65) Prior Publication Data

US 2007/0052766 A1 Mar. 8, 2007

(51) Int. Cl.
*B41J 2/02* (2006.01)

(52) U.S. Cl. ..... 347/73

(58) Field of Classification Search ..... 347/61, 347/63, 65, 66, 75, 73
See application file for complete search history.

(56) References Cited

U.S. PATENT DOCUMENTS

| | | | | |
|---|---|---|---|---|
| 3,878,519 | A | 4/1975 | Eaton | |
| 4,068,241 | A * | 1/1978 | Yamada | 347/75 |
| 4,346,387 | A | 8/1982 | Hertz | |
| 4,638,328 | A | 1/1987 | Drake et al. | |
| 5,502,471 | A | 3/1996 | Obermeier et al. | |
| 6,079,821 | A | 6/2000 | Chwalek et al. | |
| 6,193,360 | B1 * | 2/2001 | Nishiwaki et al. | 347/70 |
| 6,213,595 | B1 | 4/2001 | Anagnostopoulos et al. | |
| 6,217,163 | B1 | 4/2001 | Anagnostopoulos et al. | |
| 6,450,619 | B1 | 9/2002 | Anagnostopoulos et al. | |
| 6,497,510 | B1 | 12/2002 | Delametter et al. | |
| 6,505,921 | B2 | 1/2003 | Chwalek et al. | |
| 2002/0075359 | A1 | 6/2002 | Wuu et al. | |
| 2004/0090483 | A1 | 5/2004 | Gue et al. | |
| 2006/0028511 | A1 * | 2/2006 | Chwalek et al. | 347/65 |

* cited by examiner

*Primary Examiner*—K. Feggins
(74) *Attorney, Agent, or Firm*—William R. Zimmerli

(57) ABSTRACT

A fluid ejection device, a method of cleaning the device, and a method of operating the device are provided. The device includes a substrate having a first surface and a second surface located opposite the first surface. A nozzle plate is formed over the first surface of the substrate and has a nozzle through which fluid is ejected. A drop forming mechanism is situated at the periphery of the nozzle. A fluid chamber is in fluid communication with the nozzle and has a first wall and a second wall. The first wall and the second wall are positioned at an angle other than 90° relative to each other. A fluid delivery channel is formed in the substrate and extends from the second surface of the substrate to the fluid chamber. The fluid delivery channel is in fluid communication with the fluid chamber.

28 Claims, 16 Drawing Sheets

CONTINUOUS FLUID JET EJECTOR WITH ANISOTROPICALLY ETCHED FLUID CHAMBERS

CROSS REFERENCE TO RELATED APPLICATIONS

Reference is made to commonly assigned, U.S. patent application Ser. No. 10/911,186 filed Aug. 4, 2004, entitled "A FLUID EJECTOR HAVING AN ANISOTROPIC SURFACE CHAMBER ETCH," in the names of James M. Chwalek, John A. Lebens, Christopher N. Delametter, David P. Trauernicht, and Gary A. Kneezel, and published Feb. 9, 2006 as Pub. No. US 2006/0028511 A1.

FIELD OF THE INVENTION

This invention relates generally to the field of digitally controlled fluid ejection devices, and in particular to fluid ejection devices for continuous fluid jet printers in which a liquid stream breaks into drops, some of which are selectively deflected.

BACKGROUND OF THE INVENTION

Traditionally, digitally controlled color printing capability is accomplished by one of two technologies. In each technology, ink is fed through channels formed in a printhead. Each channel includes a nozzle from which drops of ink are selectively extruded and deposited upon a medium. When color printing is desired, each technology typically requires independent ink supplies and separate ink delivery systems for each ink color used during printing.

The first technology, commonly referred to as "drop-on-demand" ink jet printing, provides ink drops for impact upon a recording surface using a pressurization actuator (thermal, piezoelectric, etc.). Selective activation of the actuator causes the formation and ejection of a flying ink drop that crosses the space between the printhead and the print media and strikes the print media. The formation of printed images is achieved by controlling the individual formation of ink drops, as is required to create the desired image. Typically, a slight negative pressure within each channel keeps the ink from inadvertently escaping through the nozzle, and also forms a slightly concave meniscus at the nozzle, thus helping to keep the nozzle clean.

Conventional "drop-on-demand" ink jet printers utilize a pressurization actuator to produce the ink jet drop at orifices of a print head. Typically, one of two types of actuators are used including heat actuators and piezoelectric actuators. With heat actuators, a heater, placed at a convenient location, heats the ink causing a quantity of ink to phase change into a gaseous steam bubble that raises the internal ink pressure sufficiently for an ink drop to be expelled. With piezoelectric actuators, an electric field is applied to a piezoelectric material possessing properties that create a mechanical stress in the material causing an ink drop to be expelled. The most commonly produced piezoelectric materials are ceramics, such as lead zirconate titanate, barium titanate, lead titanate, and lead metaniobate.

The second technology, commonly referred to as "continuous stream" or "continuous" ink jet printing, uses a pressurized ink source which produces a continuous stream of ink drops. Conventional continuous ink jet printers utilize electrostatic charging devices that are placed close to the point where a filament of working fluid breaks into individual ink drops. The ink drops are electrically charged and then directed to an appropriate location by deflection electrodes having a large potential difference. When no print is desired, the ink drops are deflected into an ink capturing mechanism (catcher, interceptor, gutter, etc.) and either recycled or disposed of. When print is desired, the ink drops are not deflected and allowed to strike a print media. Alternatively, deflected ink drops may be allowed to strike the print media, while non-deflected ink drops are collected in the ink capturing mechanism.

U.S. Pat. No. 3,878,519, issued to Eaton, on Apr. 15, 1975, discloses a method and apparatus for synchronizing drop formation in a liquid stream using electrostatic deflection by a charging tunnel and deflection plates.

U.S. Pat. No. 4,346,387, issued to Hertz, on Aug. 24, 1982, discloses a method and apparatus for controlling the electric charge on drops formed by the breaking up of a pressurized liquid stream at a drop formation point located within the electric field having an electric potential gradient. Drop formation is effected at a point in the field corresponding to the desired predetermined charge to be placed on the drops at the point of their formation. In addition to charging tunnels, deflection plates are used to actually deflect drops.

U.S. Pat. No. 4,638,382, issued to Drake et al., on Jan. 20, 1987, discloses a continuous ink jet printhead that utilizes constant thermal pulses to agitate ink streams admitted through a plurality of nozzles in order to break up the ink streams into drops at a fixed distance from the nozzles. At this point, the drops are individually charged by a charging electrode and then deflected using deflection plates positioned the drop path.

As conventional continuous ink jet printers utilize electrostatic charging devices and deflector plates, they require many components and large spatial volumes in which to operate. This results in continuous ink jet printheads and printers that are complicated, have high energy requirements, are difficult to manufacture, and are difficult to control.

U.S. Pat. No. 6,079,821, issued to Chwalek et al., on Jun. 27, 2000, discloses a continuous ink jet printer that uses actuation of asymmetric heaters to create individual ink drops from a filament of working fluid and deflect those ink drops. A printhead includes a pressurized ink source and an asymmetric heater operable to form printed ink drops and non-printed ink drops. Printed ink drops flow along a printed ink drop path ultimately striking a print media, while non-printed ink drops flow along a non-printed ink drop path ultimately striking a catcher surface. Non-printed ink drops are recycled or disposed of through an ink removal channel formed in the catcher.

U.S. Pat. No. 6,497,510, issued to Delametter et al., on Dec. 24, 2002, discloses a geometry of printhead employing asymmetrically applied heat for continuous ink jet printer systems in which the improvement is an enhanced lateral flow in the ink channel near the entrance to the nozzle bore. This enhanced lateral flow within the printhead serves to lessen the amount of heat needed per degree of angle of deflection of drops which have been ejected from the printhead.

U.S. Pat. No. 6,450,619, issued to Anagnostopoulos et al., on Sep. 17, 2002, discloses a continuous ink jet printhead incorporating nozzle bores, heater elements, and associated electronics which may be made at lower cost by forming the heater elements and nozzle bores during the processing steps used to fabricate the associated electronics, for example, by CMOS processing. More expensive MEMS type processing steps are thereby kept to a minimum. Structures are provided to increase the lateral flow near the entrance to the nozzle bore.

U.S. Pat. Nos. 6,213,595 and 6,217,163, issued to Anagnostopoulos et al., on Apr. 10 and Apr. 17, 2001 respectively, disclose a continuous ink jet printhead incorporating a heater having a plurality of selectively independently actuated sections which are positioned along respectively different portions of the nozzle bore's perimeter. By selecting which segments are to be actuated (and optionally adjusting the power level to different segments), the drop placement may be more accurately controlled.

U.S. Pat. No. 6,505,921, issued to Chwalek et al., on Jan. 14, 2003, discloses an embodiment of a continuous ink jet printing system incorporating a heater near the nozzle bore, the volume of each ink drop broken from the ink stream being determined by the frequency of activation of the heater; and further incorporating a gas flow which deflects droplets of one size into a nonprinting path, while droplets of another size are allowed to strike the recording medium.

It may be appreciated that low cost, excellent image quality, high printing throughput, and high reliability are important advantages for a continuous ink jet printing system. Further improvements are desired in printhead fabrication simplicity and cost, especially those improvements which are compatible with the integration of driving and control electronics required for precise droplet control of a large number of nozzles at high resolution. In addition, to prevent image quality from degrading due to obstructions in the ink flow path in the printhead, it is desirable to provide a printhead geometry and a method for cleaning the printhead which facilitate removal of such obstructions.

SUMMARY OF THE INVENTION

According to one aspect of the invention, a continuous fluid ejection device includes a substrate having a first surface and a second surface located opposite the first surface. A nozzle plate is formed over the first surface of the substrate and has a nozzle through which fluid is ejected. A drop forming mechanism is situated at the periphery of the nozzle. A fluid chamber is in fluid communication with the nozzle and has a first wall and a second wall. The first wall and the second wall are positioned at an angle other than 90° relative to each other. A fluid delivery channel is formed in the substrate extending from the second surface of the substrate to the fluid chamber. The fluid delivery channel is in fluid communication with the fluid chamber.

According to another aspect of the invention, a method of cleaning a fluid ejection device includes providing an array of nozzles; and causing fluid to move from a first fluid delivery channel through a fluid chamber and a second fluid delivery channel in a direction transverse to the array of nozzles by creating a pressure differential between fluid in the first fluid delivery channel and fluid in the second fluid delivery channel, the fluid chamber having a first wall and a second wall, the first wall and the second wall being positioned at an angle other than 90° relative to each other.

According to another aspect of the invention, a method of continuously ejecting fluid includes providing a fluid ejection device; providing a fluid; and causing the fluid to flow through the fluid ejection device at a pressure sufficient to cause the fluid to be ejected through the nozzle. The fluid ejection device includes a substrate having a first surface and a second surface located opposite the first surface; a nozzle plate formed over the first surface of the substrate, the nozzle plate having a nozzle through which fluid is ejected; a drop forming mechanism situated at the periphery of the nozzle; a fluid chamber in fluid communication with the nozzle, the fluid chamber having a first wall and a second wall, the first wall and the second wall being positioned at an angle other than 90° relative to each other; and a fluid delivery channel formed in the substrate extending from the second surface of the substrate to the fluid chamber, the fluid delivery channel being in fluid communication with the fluid chamber.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

As described herein, the present invention provides a fluid ejection device and a method of operating the same. The most familiar of such devices are used as print heads in inkjet printing systems. The fluid ejection device described herein can be operated in a continuous mode.

Many other applications are emerging which make use of devices similar to inkjet print heads, but which emit fluids (other than inks) that need to be finely metered and deposited with high spatial precision. As such, as described herein, the term fluid refers to any material that can be ejected by the fluid ejection device described below.

Figure 1:
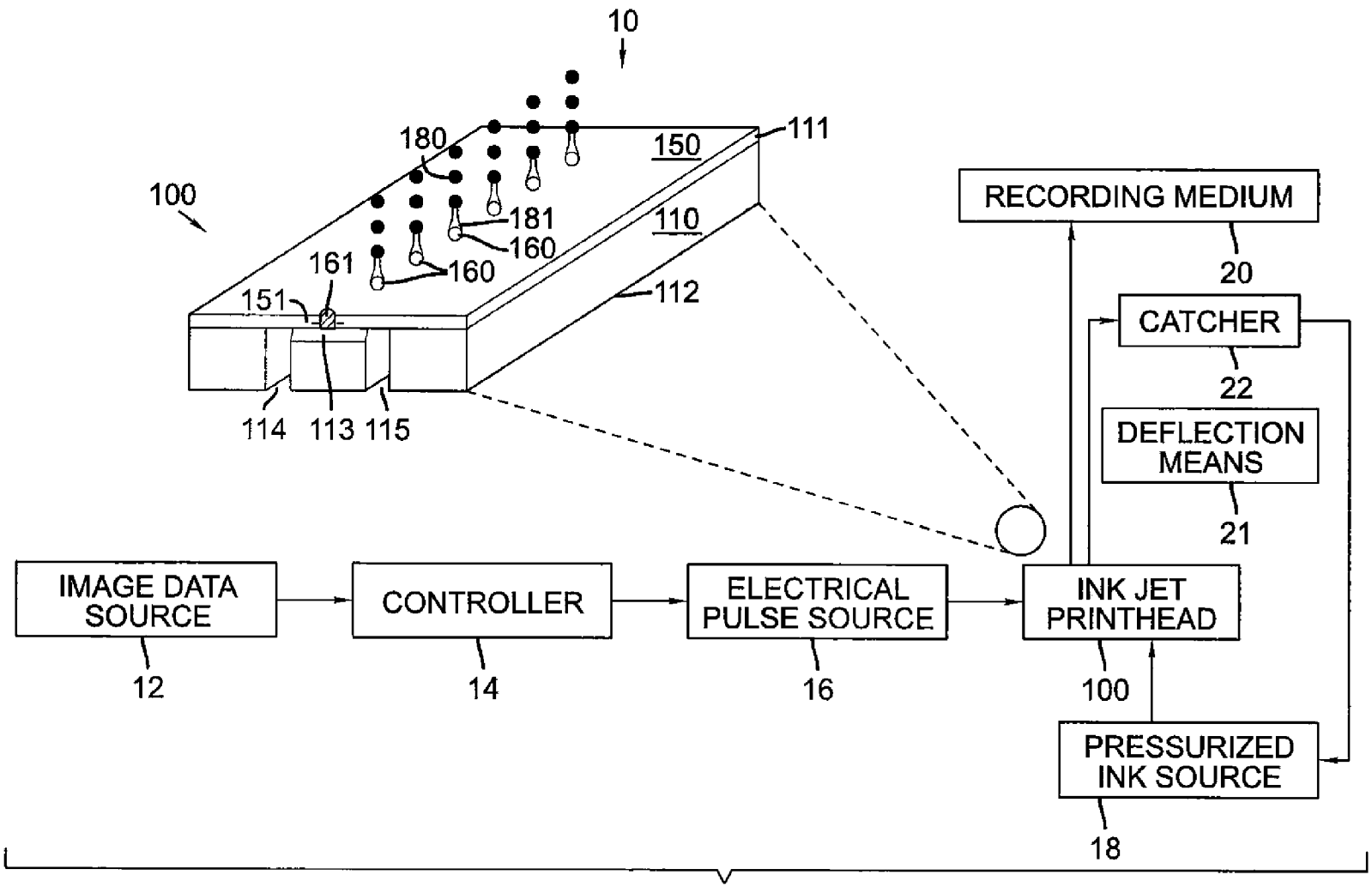
FIG. 1 is a schematic illustration of a fluid ejection system, such as a continuous ink jet printer.

Referring to FIG. 1, a schematic representation of a fluid ejection system 10, such as a continuous ink jet printer, is shown. The system includes a source 12 of data (say, image data) which provides signals that are interpreted by a controller 14 as being commands to select drops to land on recording medium 20 in appropriate positions as designated by the image data. Controller 14 outputs signals to a source 16 of electrical energy pulses which are inputted to the fluid ejection subsystem 100, for example, a continuous ink jet print head. A pressurized ink source 18 delivers ink to printhead 100 through ink delivery channels such as 114 and/or 115. Typically, fluid ejection subsystem 100 includes a plurality of fluid ejectors 160, arranged in a substantially linear row. An ink stream filament 181 is ejected from each fluid ejector 160. One example 161 of a fluid ejector is shown in cross-section. Ink is fed through ink delivery channels 114 and/or 115 to chamber 113 which is associated with fluid ejector 161. Heater elements 151 are shown at the periphery of the nozzle of fluid ejector 161. Heater elements 151 are pulsed by electrical pulse source 16 in order to break up the ink stream filaments 181 into individual droplets 180 in a controlled fashion as directed by the controller 14. Deflection means 21 may comprise asymmetric heating from heating elements 151, or it may comprise a means for deflection that is external to the printhead 100, such as a gas flow (as described, for example, in U.S. Pat. No. 6,505,921) or electrostatic deflection (as described, for example, in U.S. Pat. No. 4,638,382). Droplets 180 which are not to be part of the image on the recording medium are made to follow a path such that they are intercepted by catcher 22. Typically, ink caught by catcher 22 is reconditioned and recycled to ink source 18.

Continuous fluid ejection subsystem 100 and the associated fluid delivery channels 114 and 115, chambers 113, and fluid ejectors 160 may be fabricated in similar fashion to the way described in co-pending U.S. patent application Ser. No. 10/911,186 for use in a drop-on-demand fluid ejection device.

Figure 2A:
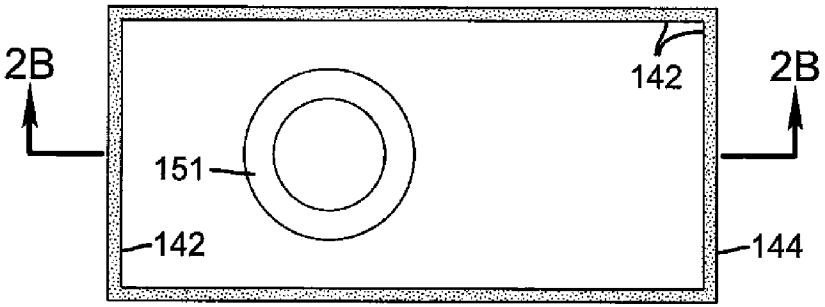
FIG. 2A shows a top view of a substrate, heater, and multilayer stack of a first embodiment of the invention.
Figure 2B:
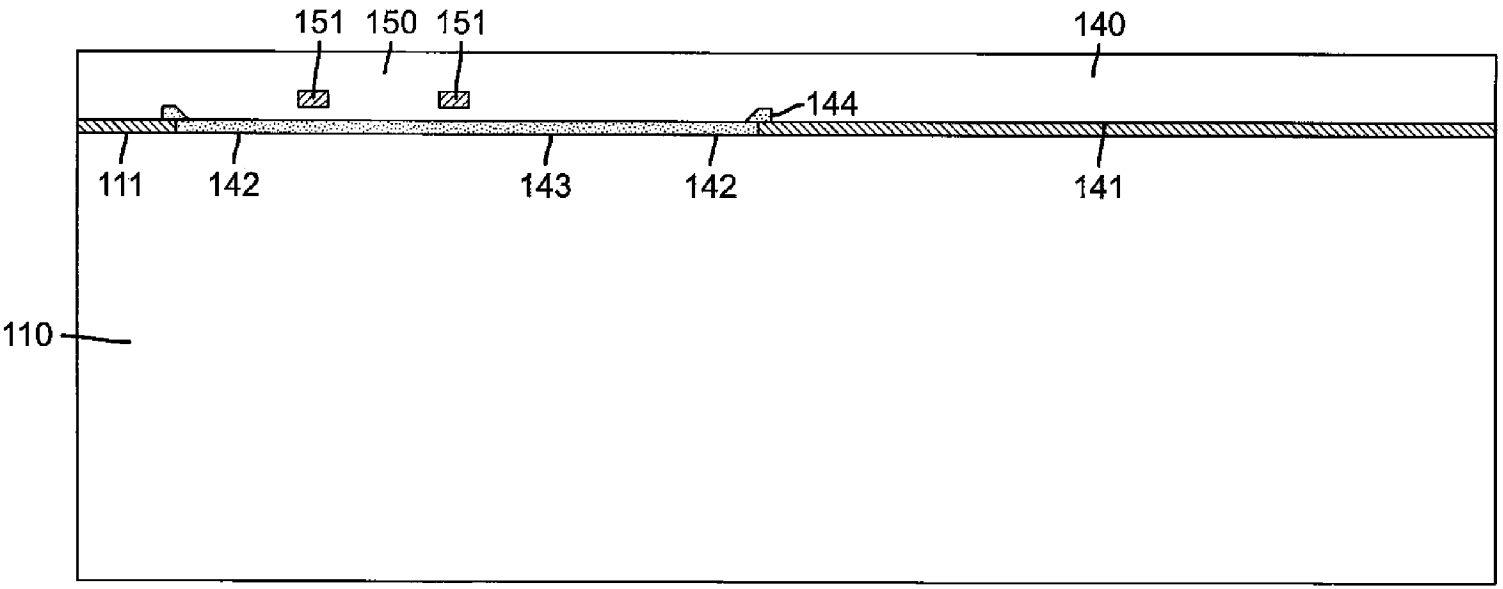
FIG. 2B shows a cross-sectional view as seen along line 2B-2B of FIG. 2A.

FIGS. 2-6 illustrate a series of process steps for forming a first embodiment of the fluid passageways of this invention. Each of the figures shows a top view in the region of a single fluid ejector, as well as a cross-sectional view. It may be appreciated that all fluid ejectors for the device are formed simultaneously. In fact, in wafer processing, typically hundreds of fluid ejecting integrated circuit devices are formed simultaneously, and are later separated to be packaged into individual printheads, for example. In FIG. 2, on first surface 111 of monocrystalline silicon substrate 110 is a multilayer stack 140 in which are formed the heater elements 151 and their associated electrodes (not shown). Optionally, within this stack, there are also formed driver and logic circuitry associated with the heaters. In some cases, said drivers and logic circuitry are fabricated using CMOS processes and this multilayer stack 140 is then frequently referred to as the CMOS stack. The multilayer stack 140 in the vicinity of the nozzles also serves as a nozzle plate 150. Containing several levels of metals, oxide and/or nitride insulating layers, and at least one resistive layer, multilayer stack 140 is typically on the order of 5 microns thick. The lowest layer of the multilayer stack 140, formed directly on silicon surface 111 is an oxide or nitride layer 141. Hereinafter layer 141 will be referred to as an oxide layer. Layer 141 has the property that it may be differentially etched with respect to the silicon substrate in the etch step that will form the fluid chamber. As part of the processing steps for the multilayer stack 140, a region 142 of oxide is removed, corresponding to the subsequent location of the fluid chamber. Layer 143 is a sacrificial layer which is deposited over the oxide layer 141, and then which is patterned so that the remaining sacrificial layer material 143 is slightly larger than the window 142 in the oxide layer 141. In other words, there is a small region of overlap 144, on the order of 1 micron, where the sacrificial layer 143 is on top of oxide layer 141. Optionally, this overlap 144 of the sacrificial layer can be subsequently removed and the sacrificial layer 143 inlaid into the oxide layer 141 using chemical mechanical polishing. Sacrificial layer 143 may be one of a variety of materials. A particular material of interest is polycrystalline silicon, or polysilicon. The patterned sacrificial layer 143 remains in place during the remainder of the processing of multilayer stack 140, but is removed later during the formation of the fluid chamber.

Also shown within the multilayer stack 140 is a heater 151 which is shown generically as a ring encircling the eventual location of the nozzle. Connections to the heater are not shown. It will be obvious to one skilled in the art that it is not required that the heater have circular or near-circular symmetry. The heating element is located substantially within the same plane as the nozzle opening with the heating element located at the periphery of the nozzle opening. By "located substantially within the same plane as the nozzle opening" it is meant that the heating element and the nozzle opening are both on the same side of the fluid chamber. By "located at the periphery of the nozzle opening" it is meant that the heating element is located laterally offset from the center of the nozzle opening. The heating element or elements may have a variety of possible shapes. The heating element or elements may surround the nozzle opening, or simply be at one or more sides of the nozzle opening. The heater may be formed of one or more segments which are adjacent to the nozzle. In fact, although for simplicity the drop forming mechanism has been described in terms of a heater which is pulsed to cause drop breakoff at controlled intervals, it is also possible to incorporate other forms of drop forming mechanisms at the periphery of the nozzle, including microactuators or piezoelectric transducers.

Figure 3A:
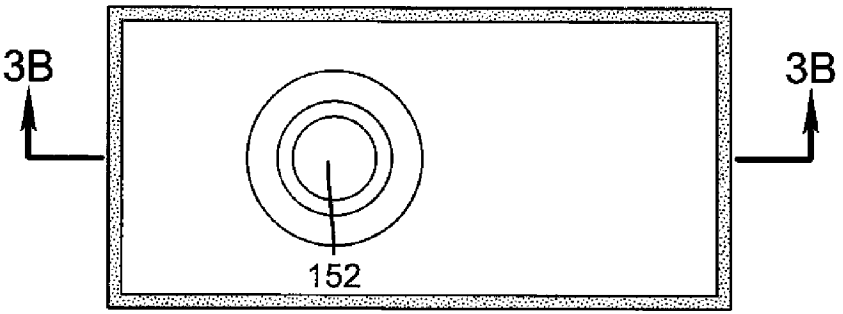
FIG. 3A shows a top view following a subsequent step of forming a nozzle.
Figure 3B:
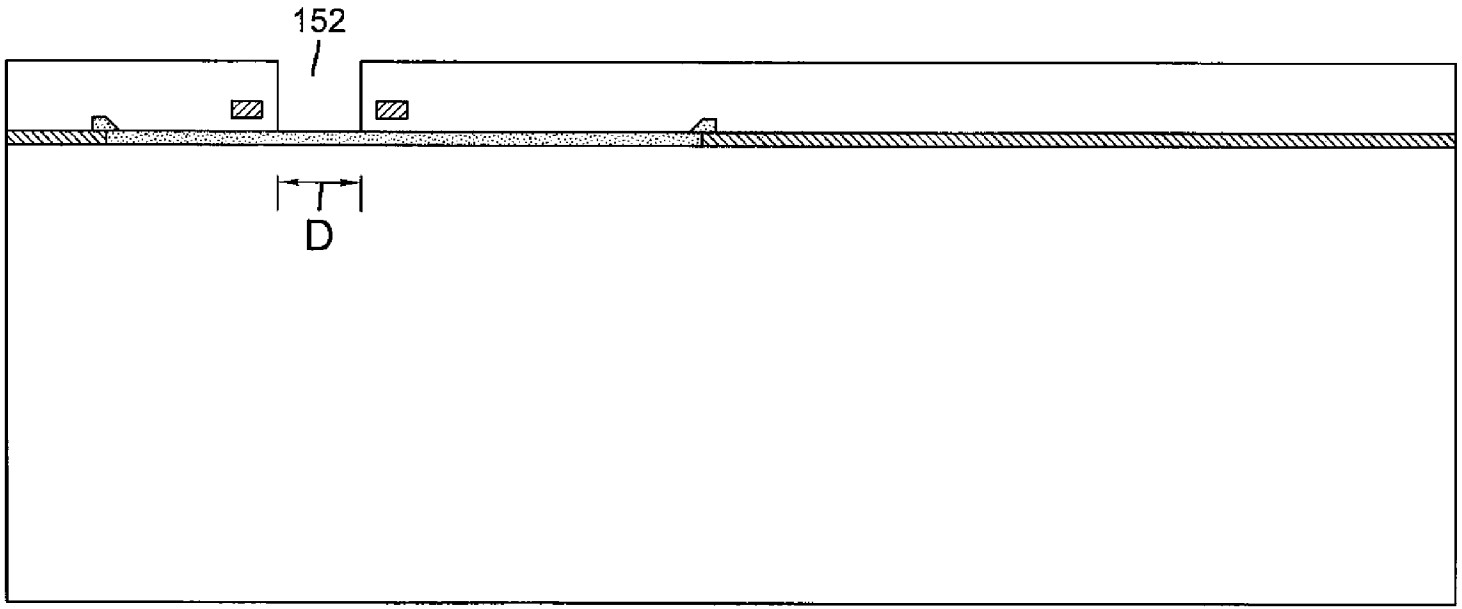
FIG. 3B shows a cross-sectional view as seen along line 3B-3B of FIG. 3A.

FIG. 3 shows the step in which the nozzle 152 is etched through the multilayer stack 140. The nozzle 152 is shown as circular and having a diameter D. In fact, a circular shape is generally preferred, but other shapes are also possible, such as elliptical, polygonal, etc.

Figure 4A:
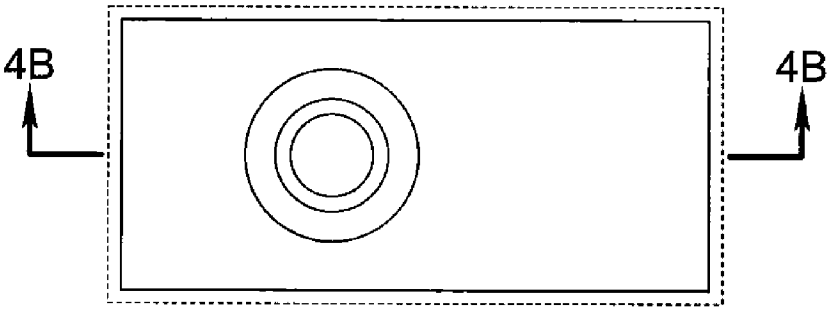
FIG. 4A shows a top view following a subsequent step of etching a sacrificial layer.
Figure 4B:
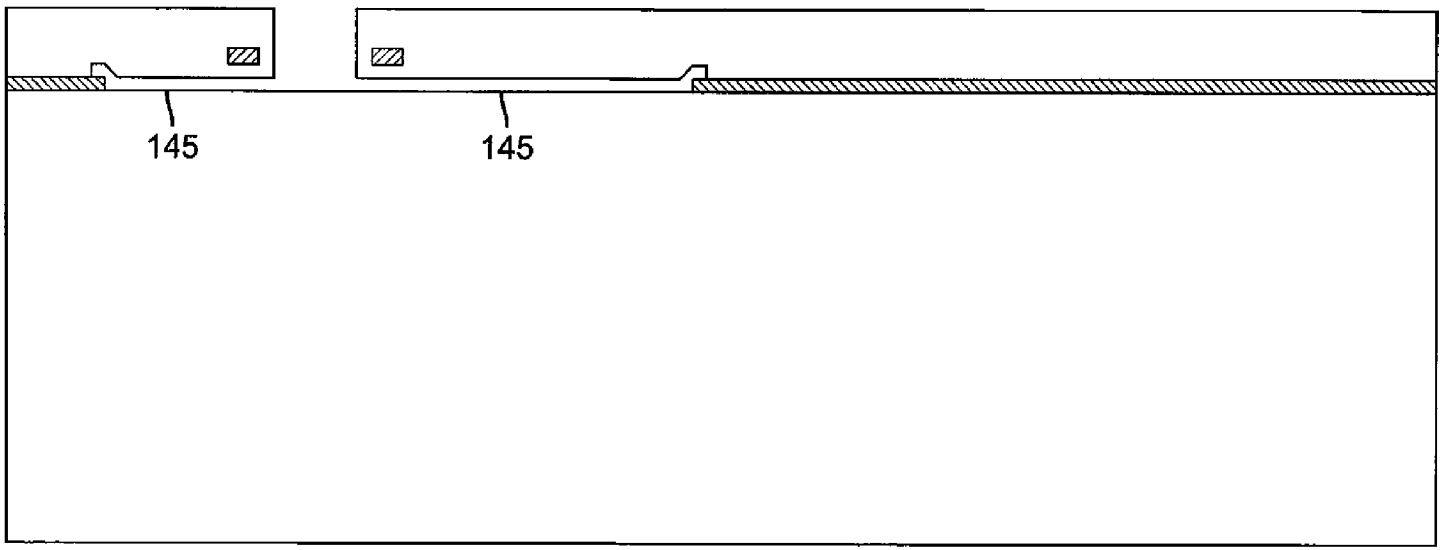
FIG. 4B shows a cross-sectional view as seen along line 4B-4B of FIG. 4A.
Figure 5A:
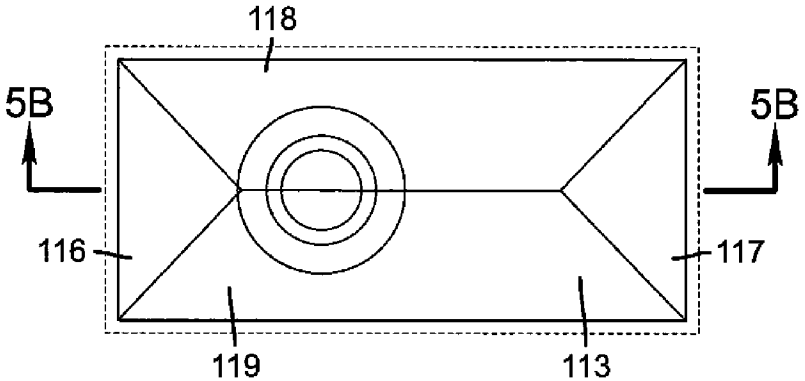
FIG. 5A shows a top view following a subsequent step of forming a fluid chamber.
Figure 5B:
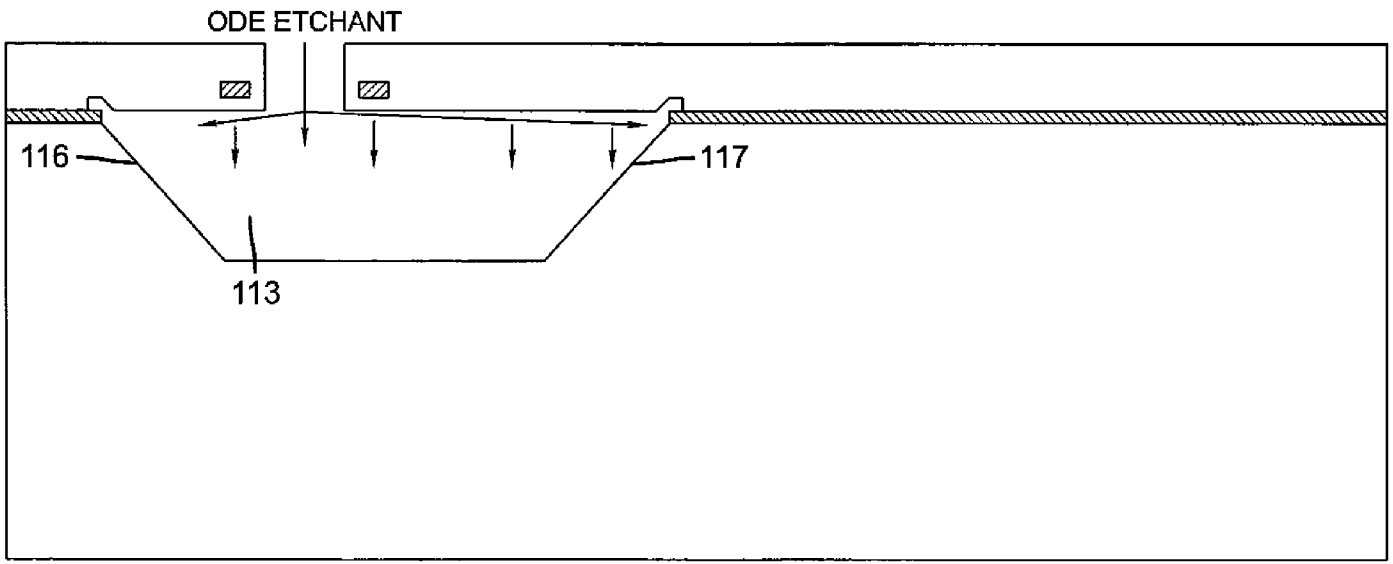
FIG. 5B shows a cross-sectional view as seen along line 5B-5B of FIG. 5A.

FIGS. 4 and 5 illustrate the steps for fabricating the fluid chamber. FIG. 4 shows the etching of the sacrificial layer 143, leaving a cavity 145. FIG. 5 shows the orientation dependent etching of the fluid chamber 113. FIGS. 4 and 5 show the etching of the sacrificial layer 143 and the etching of the chamber 113 occurring as separate steps. For the case of using polysilicon as the sacrificial layer, these two process steps occur at the same time, the etching occurring according to fronts having a width determined by the progressive removal of the polysilicon sacrificial layer, as shown in U.S. Pat. No. 6,376,291 assigned to ST Microelectronics.

Orientation dependent etching (ODE) is a wet etching step which attacks different crystalline planes at different rates. As such, orientation dependent etching is one type of anisotropic etching. As is well known in the art of orientation dependent etching, etchants such as potassium hydroxide, or TMAH tetramethylammonium hydroxide), or EDP etch the (111) planes of silicon much slower (on the order of 100 times slower) than they etch other planes. A well-known case of interest is the etching of a monocrystalline silicon wafer having (100) orientation. There are four different orientations of (111) planes which intersect a given (100) plane. The intersection of a (111) plane and a (100) plane is a line in a [110] direction. There are two different [110] directions contained within a (100) plane, and they are perpendicular to one another. Thus, if a monocrystalline silicon substrate having (100) orientation is covered with a layer, such as oxide or nitride which is resistant to etching by KOH or TMAH, but is patterned to expose a rectangle of bare silicon, where the sides of the rectangles are parallel to [110] directions, and the substrate is exposed to an etchant such as KOH or TMAH, then a pit will be etched in the exposed silicon rectangle. If the etch is allowed to proceed to completion, then the pit will have four sloping walls, each wall being a different (111) plane. If the length and width of the rectangle of exposed silicon were L and W respectively, and if L=W, then the four (111) planes would meet at a point, and the pit would be pyramid shaped. The (111) planes are at a 54.7 degree angle with respect to the (100) surface. The depth H of the pit is half the square root of 2 times the width, that is, H=0.707 W. If L>W, then the maximum depth H is still 0.707 W and the shape of the pit is a V groove with sloped side walls and sloped end walls. The length of the region of maximum depth of the pit is L−W.

As shown in FIG. 5, chamber 113 has a sloping end wall 116 located in the vicinity of the nozzle 152, and another sloping end wall 117, located at the opposite end of the chamber and having opposite slope. Forming the long sides of chamber 113 are sloping side walls 118 and 119. Two intersecting (111) planes, such as 118 and 119, are at an angle of 70.6 degrees with respect to one another.

Figure 6A:
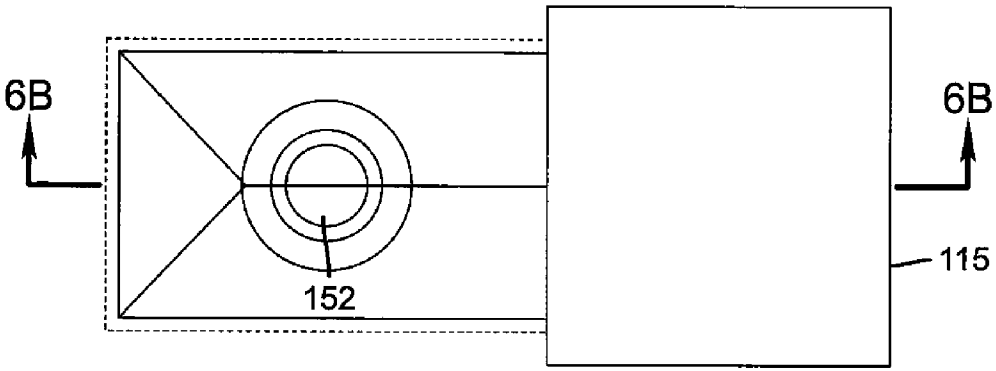
FIG. 6A shows a top view following a subsequent step of forming a fluid delivery channel.
Figure 6B:
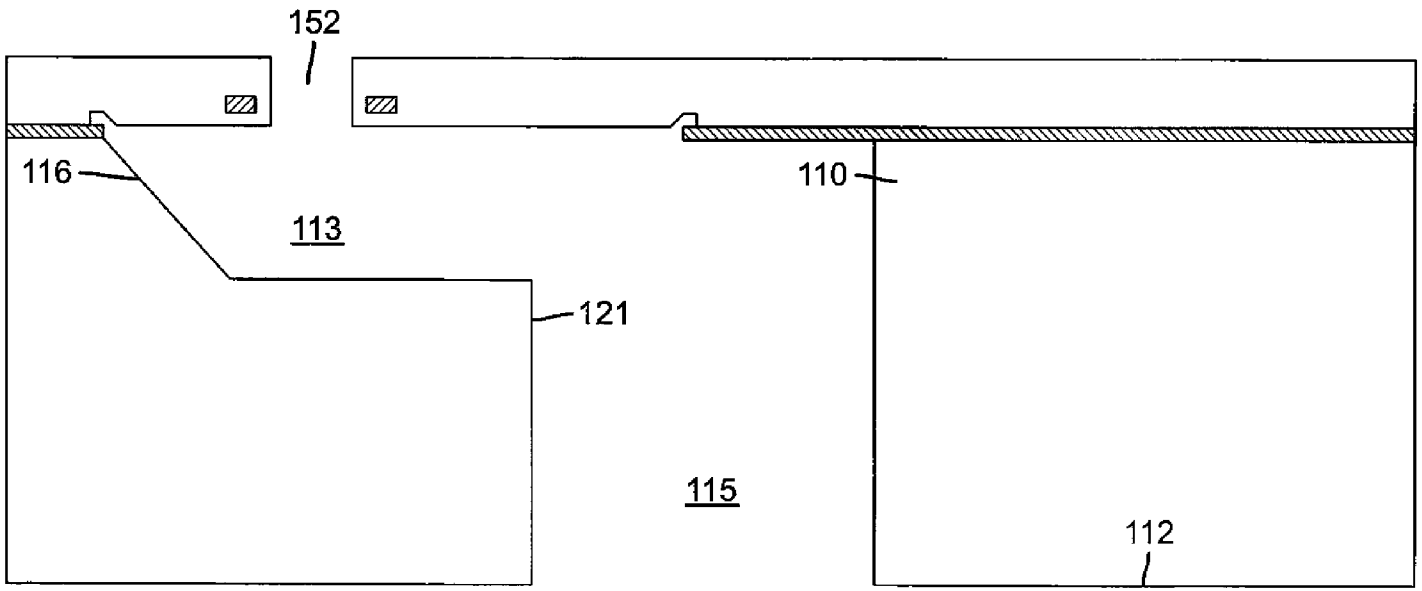
FIG. 6B shows a cross-sectional view as seen along line 6B-6B of FIG. 6A.

FIG. 6 shows the formation of the fluid delivery channel 115, for example, by deep reactive ion etching (DRIE) from the second surface 112 (i.e. the backside) of the silicon substrate. As is well known in the art, DRIE allows the etching of passages with substantially vertical walls in silicon, said passages being up to several hundred microns deep. In order to allow fluid to flow from the backside of the substrate into the chamber, the position of the DRIE etched fluid delivery channel is such that it intersects the fluid chamber 113. In the embodiment illustrated in FIG. 6, this point of intersection is designed to be between nozzle 152 and the sloping end wall 117, so that end wall 117 is removed by the DRIE forming fluid delivery channel 115. Fluid delivery channel 115 intersects with chamber 113 to form a face 121.

Figure 7:
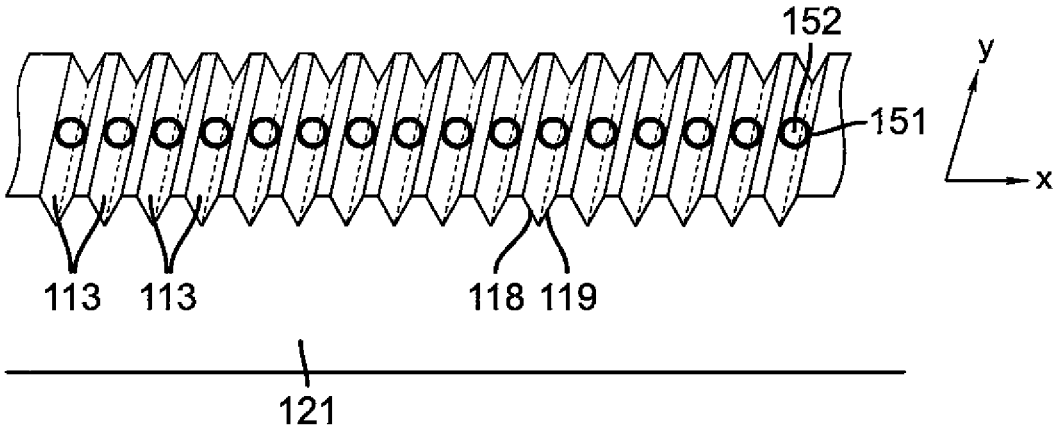
FIG. 7 shows a cutaway perspective view of several adjacent fluid chambers.

Fluid delivery channel 115 typically connects to multiple adjacent fluid chambers 113. A cutaway perspective view of adjacent chambers 113 is shown in FIG. 7. Face 121 of fluid delivery channel 115 is shown. Indicated in FIG. 7 are the sloping sidewalls 118 and 119 of each chamber 113 which are formed by orientation dependent etching and correspond to (111) planes. Also shown are an array of nozzles 152, as well as heater elements 151 which are generically illustrated as rings surrounding nozzles 152. The array direction x (i.e., the direction between adjacent nozzles), is substantially transverse to the length of the fluid chamber 113, which is along the y direction.

Figure 8A:
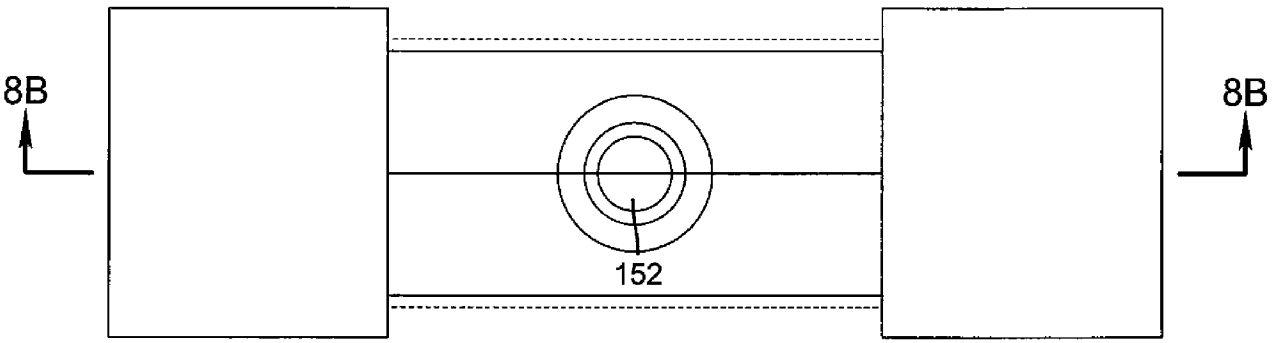
FIG. 8A shows a top view of a second embodiment of the invention having fluid delivery channels positioned on opposite sides of the nozzle.
Figure 8B:
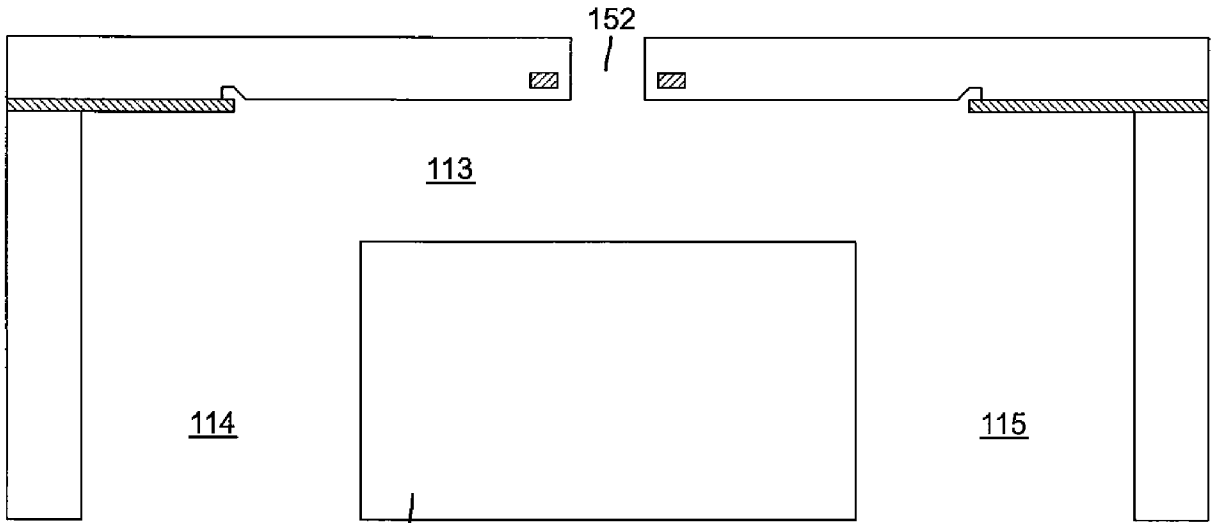
FIG. 8B shows a cross-sectional view as seen along line 8B-8B of FIG. 8A.

In the first embodiment described above, the fluid delivery channel is offset asymmetrically to one side of the nozzle. FIG. 8 illustrates a second embodiment in which there is a fluid chamber 113, a nozzle 152, and two fluid delivery channels 114 and 115, which are positioned on opposite sides of the nozzle 152. In such a design, there is a redundant fluid pathway for fluid to reach the nozzle. The fabrication method for this second embodiment is essentially the same as that for the first embodiment. However, when the deep reactive ion etching is done from the second side 112 of the substrate, the substrate is exposed to the etching process in locations corresponding to fluid delivery channel 114 as well as 115. As illustrated in FIG. 8, fluid delivery channels 114 and 115 may be positioned equidistant from the center of nozzle 152. In addition, fluid delivery channel 114 may have substantially equivalent cross-sectional area and shape as compared with fluid delivery channel 115. However, in some applications it may be advantageous not to have the fluid delivery channels not be equidistant from the nozzle, and/or not to have substantially equivalent cross-sectional area or shape.

Figure 9A:
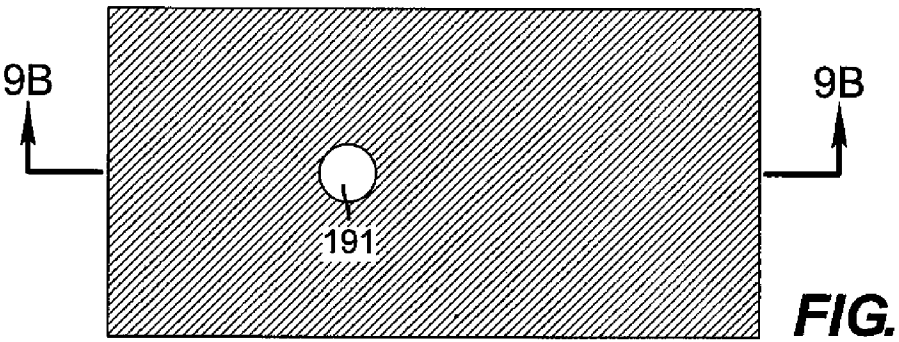
FIG. 9A shows a top view of a third embodiment of the invention having a nozzle extension formed in a layer on top of the multilayer stack.
Figure 9B:
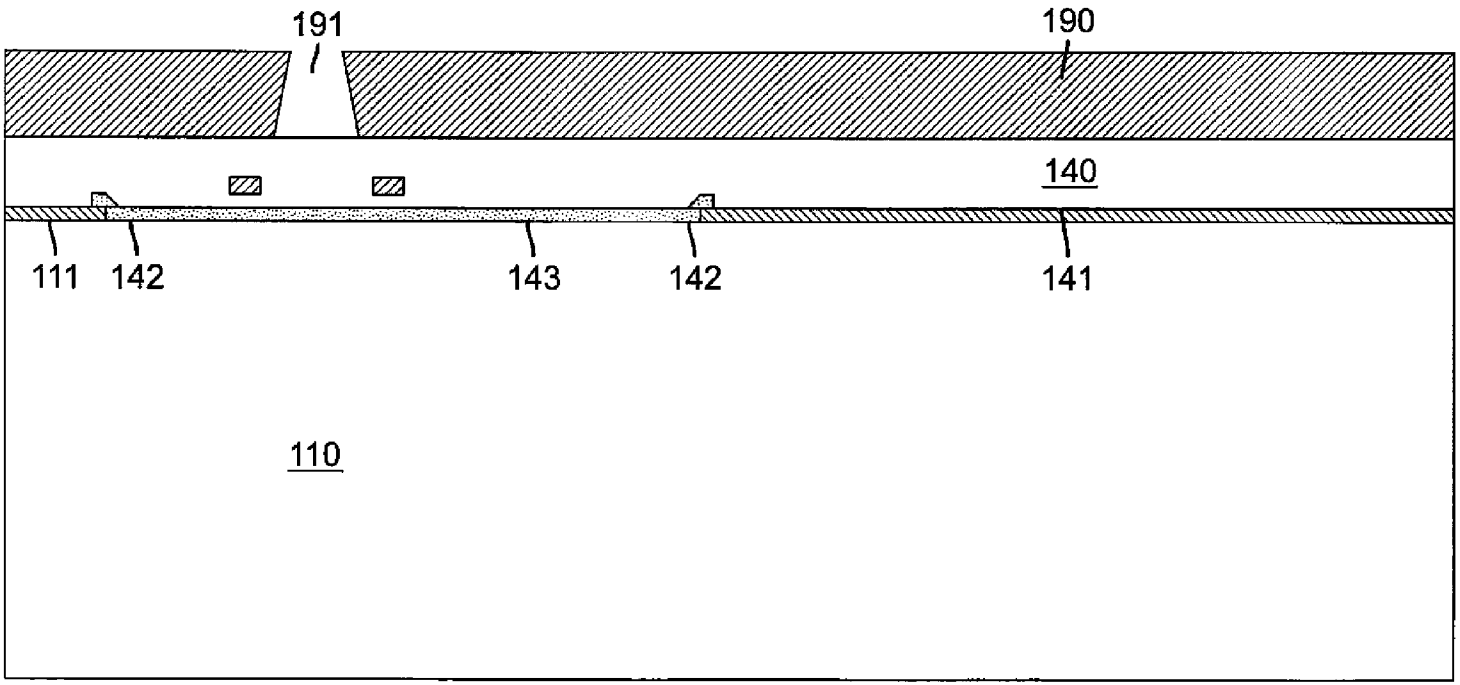
FIG. 9B shows a cross-sectional view as seen along line 9B-9B of FIG. 9A.
Figure 10A:
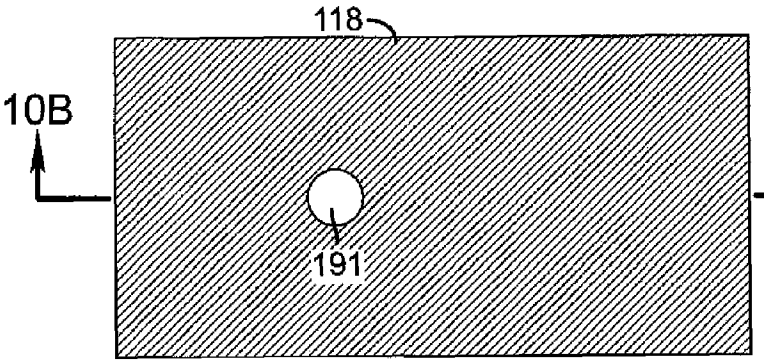
FIG. 10A shows a top view following a subsequent step of forming a fluid chamber.
Figure 10B:
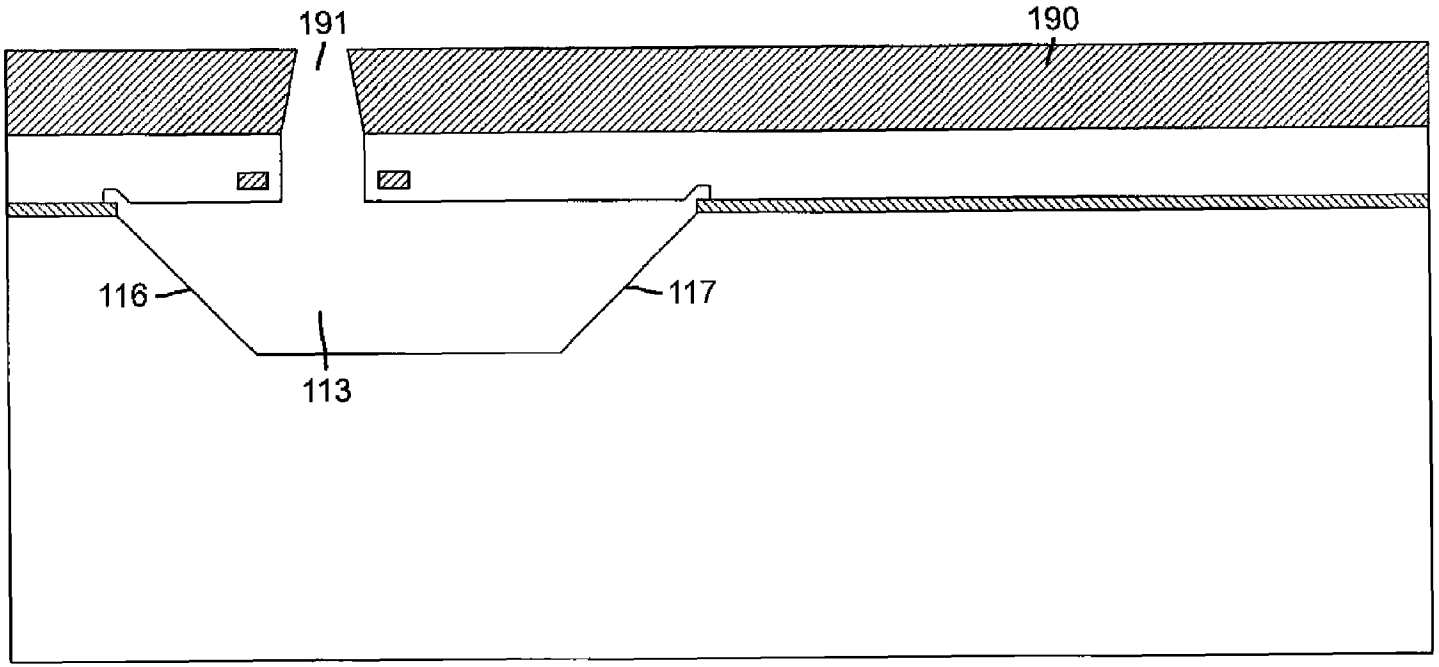
FIG. 10B shows a cross-sectional view as seen along line 10B-10B of FIG. 10A.

In the embodiments described above, the nozzle plate 150 is formed using the layers comprising multilayer stack 140. Multilayer stack 140 is typically on the order of 5 microns thick. In some applications it is desirable to have a thicker nozzle plate. FIG. 9 and FIG. 10 show a way to form a nozzle extension 191 in a polymer layer 190. Following the process step illustrated in FIG. 2, a polymer layer 190 is formed on multilayer stack 140. The polymer layer may be a photopatternable polymer such as SU8. In locations corresponding to eventual nozzle openings in multilayer stack 140, holes 191 are patterned in polymer layer 190. By suitable exposure and development conditions, holes 191 may be made such that they are narrower at the top surface of the polymer layer than at the bottom, as seen in FIG. 9. However, other hole wall profiles are also possible. After the holes 191 are patterned, the process proceeds as described previously and as shown in FIGS. 3-5, resulting in the structure shown in FIG. 10. Then, depending on the application, fluid delivery channels 114 and/or 115 may be formed as described previously. By adding the nozzle extension 191 and the polymer layer 190, the nozzle plate is made to be more robust.

Figure 11:
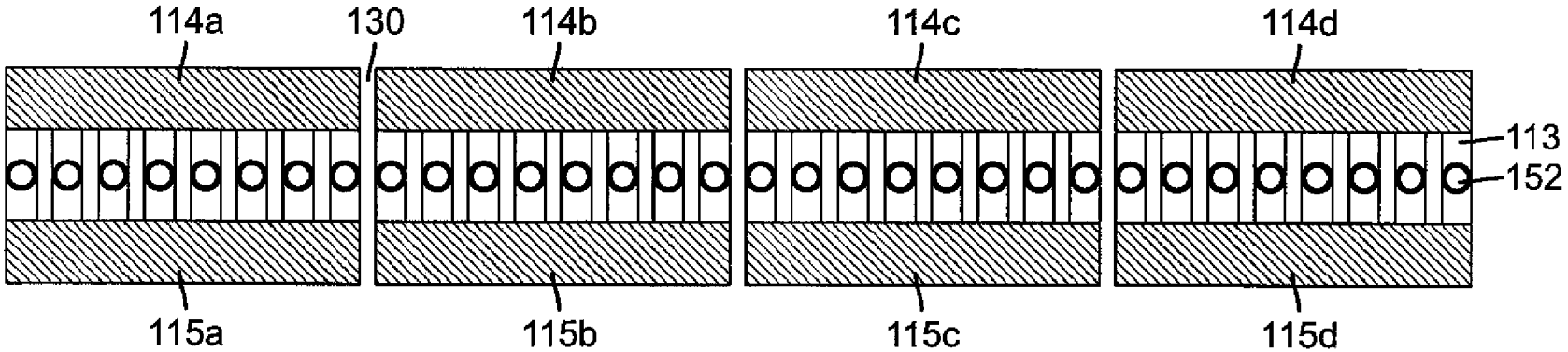
FIG. 11 shows a top view of an array of adjacent fluid chambers arranged in four groups, where each group of chambers is fed by a different pair of fluid delivery channels.

Fluid delivery channels 114 and 115 do not need to extend across the entire array of chambers 113 in a continuous fashion. As shown in the top view of FIG. 11, the fluid delivery channels may be segmented. Fluid delivery channels **114*a* and 115*a* feed one group of chambers 113. Fluid delivery channels 114*b* and 115*b* feed an adjacent group of chambers 113. Fluid delivery channels 114*c* and 115*c* feed a third group of chambers 113, while fluid delivery channels 114*d* and 115*d* feed an adjacent group of chambers 113. The advantage of such a configuration is that the ribs between adjacent fluid delivery channels (such as rib 130 between 114*a* and 114*b*) serve to provide mechanical strength for the device. Although FIG. 11 shows each of the fluid delivery channels feeding groups of eight adjacent chambers, groups smaller or larger than eight chambers are also possible. For example, it is possible to have individual fluid delivery channels 114 and/or 115 feeding each individual chamber 113, i.e. a group size of one. In some applications, it may be advantageous to supply different fluids to fluid delivery channel segments which are connected to different groups of chambers 113. The same fluid would be supplied to both ends of a group of chambers (for example through fluid delivery channels 114*a* and 115*a*), but optionally the fluid supplied through fluid delivery channel 114***b* could be different from the fluid supplied through fluid delivery channel 114*a*.

Figure 12A:
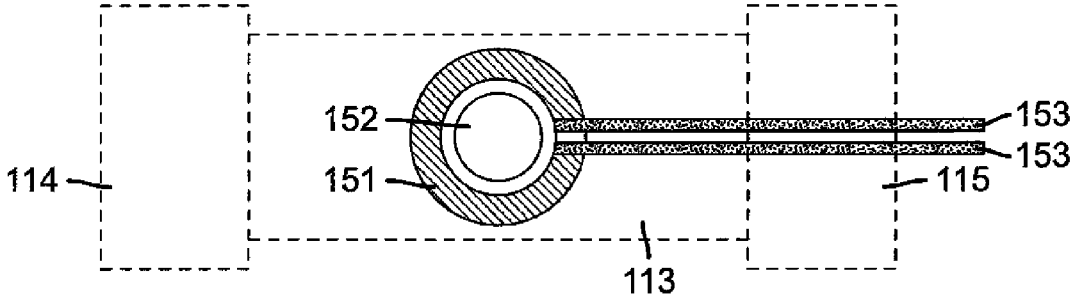
FIG. 12A shows a top view of an annular heater around the nozzle.
Figure 12B:
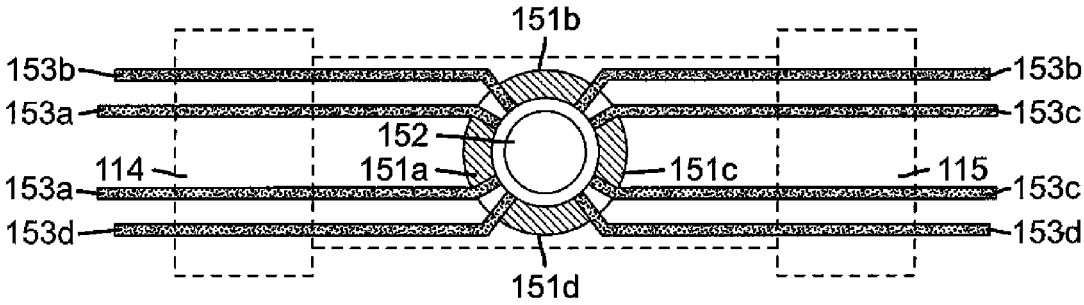
FIG. 12B shows a top view of a multi-segmented annular heater around the nozzle.
Figure 12C:
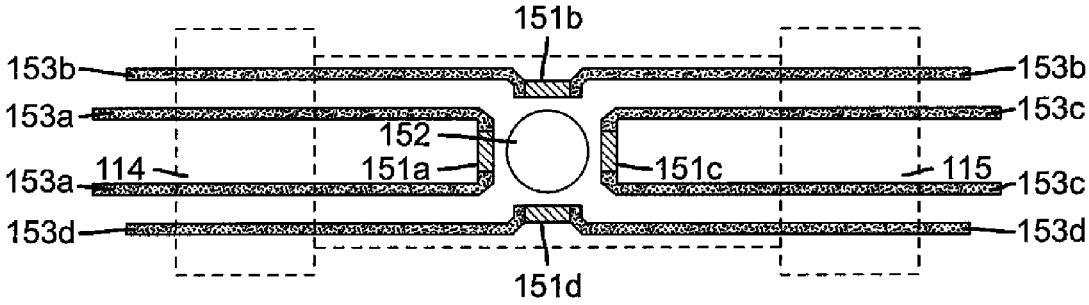
FIG. 12C shows a top view of a group of independently actuatable heater segments arranged on opposite sides of the nozzle.

FIG. 12 shows top views of several alternate heater configurations in relation to fluid chamber 113, fluid delivery channel 115 and optional fluid delivery channel 114. FIG. 12A shows an annular heater 151 around the nozzle 152. Leads 153 are provided to bring electrical power to the heater. FIG. 12B shows an annular heater that is multi-segmented. By independently powering the different heater segments, droplets can be steered in different directions. Powering a particular heater segment is accomplished by passing current through the element by means of the associated leads. For example, to power heater segment 151*a*, current is passed through leads 153*a*. Typically one of the leads 153*a* would be connected to ground and the other lead 153*a* would be connected to a transistor (not shown) to control application of a voltage across the heater. In the heater and chamber layout of FIG. 7, where the length of the fluid chamber is transverse to the nozzle array direction, by asymmetrically actuating (i.e. supplying power to) heater segments 151*a* and 151*c*, one can adjust the position of the droplets in a path which moves them more or less toward the non printing position where they will be caught by the catcher 22 of FIG. 1. By asymmetrically actuating heater segments 151*b* and 151*d*, one can steer the drops within the array direction. FIG. 12C is a similar heater configuration to FIG. 12B, but here the heater segments are rectangular rather than being curved. An advantage of a rectangular heater segment geometry is that the current flow path is of equal length at all points from one end of the heater segment to the other end. Therefore the current, and the resulting power dissipation, will be uniform across the heater. By contrast, a curved heater segment, such as 151*a* in FIG. 12B, has a shorter current flow path in the part of the heater that is closest to the nozzle 152 than does a part of the heater that is farther from the nozzle. As a result, there will be current crowding (higher current in the part of the heater that is closer to the nozzle), resulting in a heater temperature profile that is hotter closer to the nozzle 152. The use of segmented ring and segmented rectangular heaters for droplet formation and/or drop steering is described in U.S. Pat. No. 6,517,197.

Figure 13:
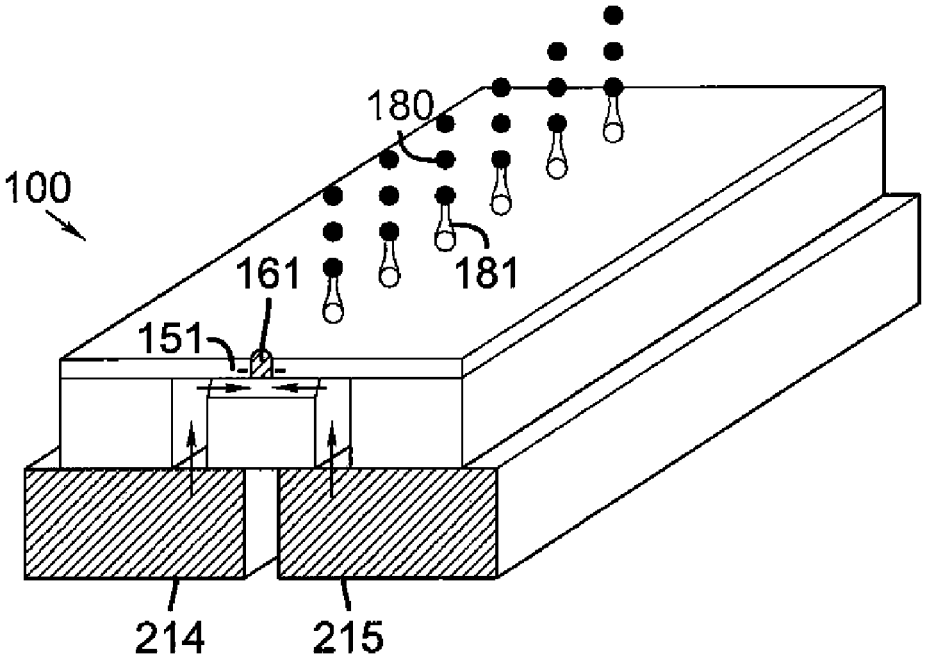
FIG. 13 shows a perspective view of positively pressurized fluid sources connected to the fluid ejection subsystem, so that fluid is ejected from the nozzles.

While the discussion of FIG. 12B and FIG. 12C above describes independently addressable multisegmented heaters within the context of steering of droplets in a continuous fluid ejection subsystem, such multisegmented heaters may alternatively be used to generate and/or steer droplets in a drop-on-demand fluid ejection subsystem. An example of such a drop-on-demand fluid ejection subsystem is the backshooting bubblejet fluid ejection subsystem described in co-pending U.S. patent application Ser. No. 10/911,186. FIG. 13 shows pressurized fluid sources 214 and 215 connected to fluid ejection subsystem 100. Fluid sources 214 and 215 are fluidically connected to fluid delivery channels 114 and 115 respectively (shown but not labeled in FIG. 13). In continuous jetting operation, fluid sources 214 and 215 are maintained at positive pressure sufficient to force fluid in the direction of the arrows through fluid delivery channels 114 and 115 respectively and into fluid chambers 113. Flow through the length of fluid chamber 113 imparts a lateral velocity flow component to the fluid, allowing the type of enhanced ink drop deflection described in previously referenced U.S. Pat. No. 6,497,510. (For applications where a polymer layer 190 and nozzle extension 191 are used, it is advantageous for the nozzle extension to have the retrograde profile shown in FIG. 10. This allows a lateral flow component to be maintained within the fluid.) The fluid is then ejected as a stream of fluid from each nozzle. These streams are then controllably broken into droplets 180, for example by actuating heating elements 151 as described previously.

Figure 14A:
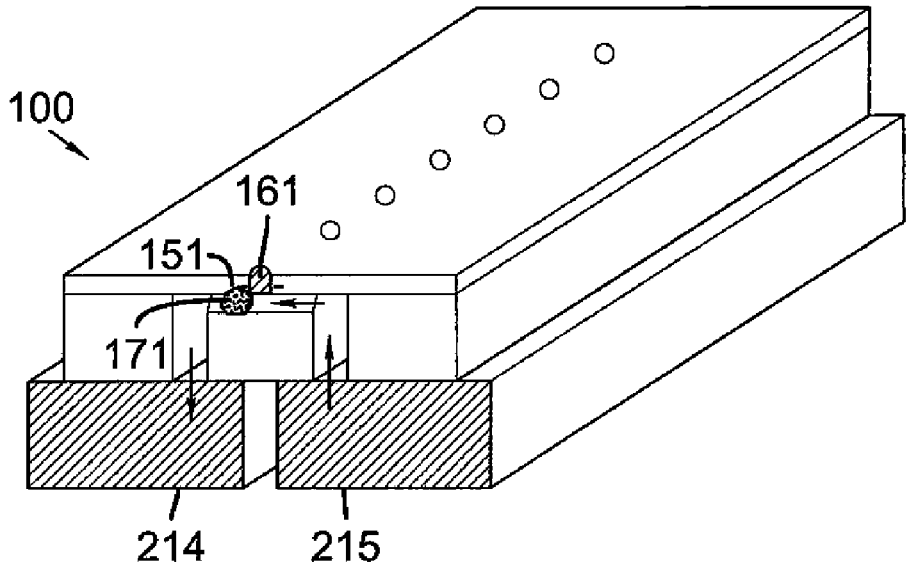
FIG. 14A shows a perspective view of differentially pressurized fluid sources connected to the fluid ejection subsystem, so that fluid is flushed through the fluid chambers to remove obstructions.
Figure 14B:
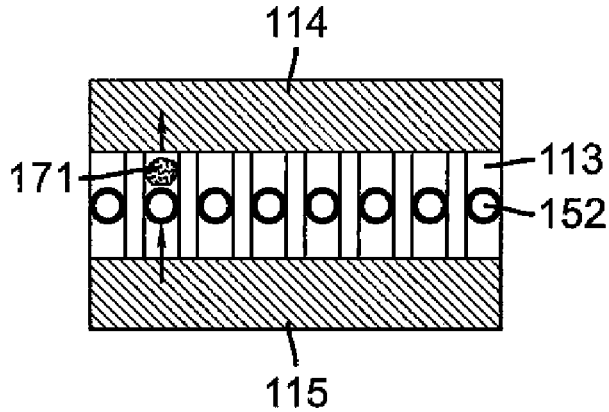
FIG. 14B shows a top view of fluid flushing through several adjacent chambers.

For the case where fluid sources 214 and 215 are independently pressurized, an advantageous flushing method is enabled in order to remove obstructions such as particulate debris or other contaminants from the fluid passageways, including the fluid chambers. Particulate debris or other contaminants may be due to foreign particles, or they may result from ink residue. FIG. 14A shows a perspective view and FIG. 14B shows a top view representing the fluid chambers 113, obstruction 171, and the fluid flow directions which occur when fluid source 215 is pressurized positively and fluid source 214 is pressurized negatively. In particular, fluid flows from fluid source 215, through fluid delivery channel 115 into the ends of chambers 113 closest to fluid delivery channel 115. The fluid then is caused to move through the chambers in a direction which is transverse to the array of nozzles. This fluid flow flushes obstruction 171 out of the chambers 113 through fluid delivery channel 114 and into fluid source 214, where the debris may be captured. Optionally, the nozzles may be capped during this flushing process. Strictly speaking, it is not necessary that the pressure in fluid source 215 be positive and the pressure in fluid source 214 be negative during the flushing operation, only that there be a pressure differential between the two fluid sources 214 and 215. Preferably the nozzles should be held at a higher pressure than fluid source 214 during the flushing process so that the obstruction is not driven into the nozzles.

While the flushing process has been described above in the context of the continuous fluid ejection device described herein, it is also applicable to drop-on-demand fluid ejection devices having two fluid delivery channels which may be independently pressurized, see, for example, FIG. 51 of co pending U.S. patent application Ser. No. 10/911,186 showing a drop-on-demand fluid ejector for which this flushing process could be used.

The invention has been described in detail with particular reference to certain preferred embodiments thereof, but it will be understood that variations and modifications can be effected within the scope of the invention.

PARTS LIST

10 fluid ejection system
12 image data source
14 controller
16 electrical pulse source
18 pressurized ink source
20 recording medium
21 deflection means
22 catcher
100 ink jet printhead
110 substrate
111 first surface of substrate
112 second surface of substrate
113 fluid chamber
114 fluid delivery channel
115 fluid delivery channel
116 end wall of fluid chamber
117 end wall of fluid chamber
118 side wall of fluid chamber
119 side wall of fluid chamber
121 face of fluid delivery channel
130 rib between adjacent fluid delivery channels
140 multilayer stack

141 lowest layer of multilayer stack 140, formed on surface 111
142 window in layer 141 to expose substrate surface 111
143 sacrificial layer material
144 region of overlap of sacrificial material 143 on layer 141
145 cavity between 140 and 111 formed by etching material 143
150 nozzle plate formed as part of multilayer stack 140
151 heater element(s)
152 nozzle
153 leads to heater elements
160 row of fluid ejectors
161 one example of a fluid ejector
171 obstruction
180 ejected drop of fluid
181 ink stream filament
190 polymer layer
191 nozzle extension
214 fluid source
215 fluid source

The invention claimed is:

1. A continuous fluid ejection device comprising:
a substrate having a first surface and a second surface located opposite the first surface;
a nozzle plate formed over the first surface of the substrate, the nozzle plate having a nozzle through which fluid is ejected;
a drop forming mechanism situated at the periphery of the nozzle;
a fluid chamber in fluid communication with the nozzle, the fluid chamber having a first wall and a second wall, the first wall and the second wall being positioned within the fluid chamber at an angle other than 90° relative to each other and extending within the fluid chamber to the first surface; and
a fluid delivery channel formed in the substrate extending from the second surface of the substrate to the fluid chamber, the fluid delivery channel being in fluid communication with the fluid chamber.

2. The device according to claim 1, the fluid delivery channel being a first fluid delivery channel and the fluid chamber being at the nozzle, the device further comprising:
a second fluid delivery channel formed in the substrate extending from the second surface of the substrate to the fluid chamber, the second fluid delivery channel being in fluid communication with the fluid chamber, wherein the first fluid delivery channel and second fluid delivery channel are positioned on opposite sides of the nozzle and are separated from one another by the fluid chamber.

3. The device according to claim 2, wherein the first fluid delivery channel and the second fluid delivery channel have substantially equivalent cross sectional areas.

4. The device according to claim 2, wherein the first fluid delivery channel and the second fluid delivery channel have substantially equivalent cross sectional shapes.

5. The device according to claim 1, wherein the substrate is a monocrystalline substrate having a (100) orientation.

6. The device according to claim 5, wherein the first wall and the second wall are each (111) type planes.

7. The device according to claim 1, further comprising a nozzle extension located on a side of the nozzle plate opposite that of the fluid chamber.

8. The device according to claim 7, wherein the nozzle extension comprises a polymer layer disposed on the nozzle plate.

9. The device according to claim 8, wherein the polymer layer is photo-patternable.

10. The device according to claim 7, wherein the nozzle extension includes an opening in fluid communication with the fluid chamber through the nozzle of the nozzle plate.

11. The device according to claim 10, the nozzle extension having a thickness, wherein the opening of the nozzle extension has a cross sectional area which varies across the thickness of the nozzle extension.

12. The device according to claim 11, the nozzle extension having a first surface located adjacent to the fluid chamber and a second surface located spaced apart from the first surface in a direction away from the fluid chamber, wherein the cross sectional area is smallest at the second surface.

13. The device according to claim 1, the fluid chamber being a first fluid chamber, the device further comprising:
a second fluid chamber in fluid communication with a second nozzle, the second fluid chamber having a first wall and a second wall, the first wall and the second wall of the second fluid chamber being positioned at an angle other than 90° relative to each other and extending within the second fluid chamber to the first surface, wherein the second fluid delivery channel is in fluid communication with the second fluid chamber and the first fluid chamber.

14. The device according to claim 1, wherein the first and second walls are end walls within the fluid chamber, and wherein the fluid chamber has third and fourth side walls positioned within the fluid chamber at an angle other than 90° relative to each other and extending within the fluid chamber to the first surface.

15. A continuous fluid ejection device comprising:
a substrate having a first surface and a second surface located opposite the first surface;
a nozzle plate formed over the first surface of the substrate, the nozzle plate having a nozzle through which fluid is ejected;
a drop forming mechanism situated at the periphery of the nozzle:
a fluid chamber in fluid communication with the nozzle, the fluid chamber having a first wall and a second wall, the first wall and the second wall being positioned at an angle other than 90° relative to each other;
a first fluid delivery channel formed in the substrate extending from the second surface of the substrate to the fluid chamber, the first fluid delivery channel being in fluid communication with the fluid chamber, and
a second fluid delivery channel formed in the substrate extending from the second surface of the substrate to the fluid chamber, the second fluid delivery channel being in fluid communication with the fluid chamber,
wherein the first fluid delivery channel and second fluid delivery channel are positioned on opposite sides of the nozzle, and
wherein the first fluid delivery channel and the second fluid delivery channel are positioned equidistant from a center of the nozzle as viewed from a plane perpendicular to the nozzle.

16. A continuous fluid ejection device comprising:
a substrate having a first surface and a second surface located opposite the first surface;
a nozzle plate formed over the first surface of the substrate, the nozzle plate having a nozzle through which fluid is ejected;
a drop forming mechanism situated at the periphery of the nozzle;
a fluid chamber in fluid communication with the nozzle, the fluid chamber having a first wall and a second wall, the first wall and the second wall being positioned at an angle other than 90° relative to each other; and a fluid delivery channel formed in the substrate extending from the second surface of the substrate to the fluid chamber, the fluid delivery channel being in fluid communication with the fluid chamber, wherein the drop forming mechanism is a heater.

17. The device according to claim 16, wherein the heater includes a plurality of heaters located on opposite sides of the nozzle.

18. The device according to claim 17, wherein the plurality of heaters include asymmetrically actuatable heaters.

19. The device according to claim 16, wherein the heater includes a multi-segmented heater.

20. The device according to claim 19, wherein at least one of the segments of the multi-segmented heater is independently actuatable with respect to the other segments of the multi-segmented heater.

21. A continuous fluid ejection device comprising:

a substrate having a first surface and a second surface located opposite the first surface;

a nozzle plate formed over the first surface of the substrate, the nozzle plate having a nozzle through which fluid is ejected;

a drop forming mechanism situated at the periphery of the nozzle;

a fluid chamber in fluid communication with the nozzle, the fluid chamber having a first wall and a second wall, the first wall and the second wall being positioned at an angle other than 90° relative to each other;

a fluid deliver channel formed in the substrate extending from the second surface of the substrate to the fluid chamber the fluid deliver channel being in fluid communication with the fluid chamber; and a deflection mechanism operably associated with the drop forming mechanism.

22. The device according to claim 21, wherein the deflection mechanism comprises a gas flow.

23. The device according to claim 21, wherein the deflection mechanism comprises a heater.

24. The device according to claim 21, wherein the deflection mechanism comprises an electrostatic deflection system.

25. A method of continuously ejecting fluid comprising:

providing a fluid ejection device, the fluid ejection device comprising:

a substrate having a first surface and a second surface located opposite the first surface;

a nozzle plate formed over the first surface of the substrate, the nozzle plate having a nozzle trough which fluid is ejected;

a drop forming mechanism situated at the periphery of the nozzle;

a fluid chamber in fluid communication with the nozzle, the fluid chamber having a first wall and a second wall, the first wall and the second wall being positioned within the fluid chamber at an angle other than 90° relative to each other and extending within the fluid chamber to the first surface; and a fluid delivery channel formed in the substrate extending from the second surface of the substrate to the fluid chamber, the fluid delivery channel being in fluid communication with the fluid chamber;

providing a fluid; and causing the fluid to flow through the fluid ejection device at a pressure sufficient to cause the fluid to be ejected though the nozzle.

26. A method of continuously ejecting fluid comprising:

providing a fluid ejection device, the fluid ejection device comprising:

a substrate having a first surface and a second surface located opposite the first surface;

a nozzle plate formed over the first surface of the substrate, the nozzle plate having a nozzle through which fluid is ejected;

a drop forming mechanism situated at the periphery of the nozzle;

a fluid chamber in fluid communication with the nozzle, the fluid chamber having a first wall and a second wall, the first wall and the second wall being positioned at an angle other than 90° relative to each other; and a fluid delivery channel formed in the substrate extending from the second surface of the substrate to the fluid chamber, the fluid delivery channel being in fluid communication with the fluid chamber;

providing a fluid;

causing the fluid to flow through the fluid ejection device at a pressure sufficient to cause the fluid to be ejected through the nozzle; and actuating the drop forming mechanism to form a drop of the fluid.

27. The method according to claim 26, wherein actuating the drop forming mechanism includes actuating a heater.

28. The method according to claim 27, wherein actuating the heater includes asymmetrically actuating the heater.

* * * * *